US007322536B2

(12) United States Patent
Garvin et al.

(10) Patent No.: US 7,322,536 B2
(45) Date of Patent: Jan. 29, 2008

(54) CONTROL SYSTEM

(75) Inventors: Alan Mark Garvin, Cambridge (NZ); Gary Johnstone Martin, Matamata (NZ)

(73) Assignee: Metso Minerals (Matamata) Limited, Mata (NZ)

( * ) Notice: Subject to any disclaimer, the term of this patent is extended or adjusted under 35 U.S.C. 154(b) by 383 days.

(21) Appl. No.: 10/517,425

(22) PCT Filed: Jun. 9, 2003

(86) PCT No.: PCT/NZ03/00118

§ 371 (c)(1),
(2), (4) Date: Jul. 13, 2005

(87) PCT Pub. No.: WO03/103841

PCT Pub. Date: Dec. 18, 2003

(65) Prior Publication Data

US 2006/0022074 A1 Feb. 2, 2006

(30) Foreign Application Priority Data

Jun. 9, 2002 (NZ) ..... 518111

(51) Int. Cl.
*B02C 23/00* (2006.01)

(52) U.S. Cl. ..... 241/34; 241/275

(58) Field of Classification Search ..... 241/34, 241/275, 33

See application file for complete search history.

(56) References Cited

U.S. PATENT DOCUMENTS 3,970,257 A 7/1976 Bartley et al.
4,026,479 A 5/1977 Bradburn et al.
4,575,013 A * 3/1986 Bartley ..... 241/275
4,662,571 A 5/1987 Bartley et al.
5,135,177 A * 8/1992 Okuhara ..... 241/275
5,145,118 A 9/1992 Canada
5,690,284 A 11/1997 Murray

FOREIGN PATENT DOCUMENTS

AU 1999 59442 A1 8/2000
AU 2002 42410 A1 11/2002
WO 07/76756 A2 10/2001

OTHER PUBLICATIONS

Derwent Abstract Accession No. 92-282189/34, Class P41 SU1681953 A1 (Ferr Metal Ore Enrichment Agglomeration), Oct. 7, 1991.

* cited by examiner

*Primary Examiner*—Faye Francis
(74) *Attorney, Agent, or Firm*—Lowe, Hauptman, Ham & Berner, LLP

(57) ABSTRACT

The present invention relates to a control system for a rock crusher which is adapted for use with Vertical Shaft Impact rock crusher which divides the rock it processes into a stream which is supplied to a central rotor and a stream which cascades past the rotor. The control system is used to control the ratio of material placed into the cascade and includes a processing means which is adapted to receive a throughput signal from at least one throughput sensor. The processing means is adapted to transmit at least one control signal to at least one control mechanism of the crasher, and at least one control signal or signals are transmitted to said control mechanism or mechanisms to adjust the amount of material entering the crusher rotor to provide a specific cascade ratio for the crusher in response to a variable throughput of material.

21 Claims, 2 Drawing Sheets

CONTROL SYSTEM

RELATED APPLICATIONS

The present application is based on International Application No. PCT/NZ03/00118 filed Jun. 9, 2003, and claims priority from, New Zealand Application Number 518111, filed Jun. 9, 2002, the disclosure of which is hereby incorporated by reference herein in its entirety.

TECHNICAL FIELD

This invention relates to an improved Control System for a rock crusher. Preferably the present invention may be adapted for use with Vertical Shaft Impact (VSI) rock crushers which divide the rock they process into a stream which is supplied to a central rotor and a stream which cascades past the rotor. Preferably the present invention may be used to control the ratio of material placed into a cascade as opposed to supplied to the rotor of the rock crusher.

BACKGROUND ART

Numerous different types of rock crushing machines are used in mining, quarrying and other similar activities to reduce the size of the rocks processed. The type of machinery employed will vary from application to application as will the initial and final sizes of the rocks processed.

One type of rock crushing machine developed is a Vertical Shaft Impact (VSI) crusher which is normally top fed by a supply system and associated conveyor belt. A good example of this type of crusher is discussed in U.S. Pat. No. 3,970,257.

Some types of VSI Crusher divide rock to be crushed into two streams of material. The first stream is supplied directly into a rotor, while the second stream is placed into a cascading flow past the side or sides of the rotor. Rock going into the rotor is spun and ejected tangently into the cascading stream of rock, to crush and break up both the cascaded and energised rock.

For different types of rocks it is preferable to vary the ratio of material supplied to the rotor to material placed into cascade past the rotor. Rock to be crushed can be processed more efficiently if the cascade ratio of material supplied to the rotor compared to material placed in the cascade is customised to suit the particular rock in question.

However, the amount of material normally supplied to the crusher can vary substantially over time, which makes it difficult to maintain a particular cascade ratio. A gate or valving mechanism associated with the rotor can be opened or closed to allow more material to enter the rotor when comparatively more material is supplied to the crusher. This will allow the cascade ratio of the crusher to be maintained as the additional material supplied to the rotor is balanced by further additional material placed into cascade. The opposite process can also be completed to reduce the size of the rotor gate when less material is supplied to the crusher to in turn maintain the correct cascade ratio for the particular material being crushed.

However, it is difficult to maintain a consistent cascade ratio for such VSI crushers using current technology. With existing technology a manual operator is required to monitor the amount of material being placed into cascade and going through the rotor and to make adjustments to the rotor gate (and potentially a feed-in rate mechanism for the crusher) to maintain the correct cascade ratio. However, this is an inefficient use of labour as well as a monotonous task for the operator. Furthermore, a degree of skill or experience is also required from the operator to correctly judge both the current cascade ratio of the crusher and also the correct settings of control systems for the crusher.

An improved control system for a rock crusher which addressed the above problems would be of advantage. A control system which could automate the monitoring of the cascade ratio of a rock crusher and which could automatically adjust the control systems of the crusher to maintain a constant cascade ratio would be of advantage.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a control system for a rock crusher, said control system being adapted to control a cascade ratio of said crusher, the control system including a processing means, said processing means being adapted to receive a throughput signal from at least one throughput sensor, said processing means also being adapted to transmit at least one control signal to at least one control mechanism of the crusher, wherein at least one control signal or signals are transmitted to each control mechanism to adjust the amount of material entering the crusher rotor to provide a specific cascade ratio for said crusher in response to a variable throughput for said crusher.

According to a further aspect of the present invention there is provided a control system substantially as described above wherein a control signal is transmitted to a control mechanism for a rotor gate for the crusher.

According to another aspect of the present invention there is provided a control system substantially as described above wherein a control signal is transmitted to a control mechanism for a crusher feed-in mechanism.

According to a further aspect of the present invention there is provided a control system substantially as described above wherein a processing means includes a programmable logic controller.

According to yet another aspect of the present invention there is provided a control system substantially as described above wherein a throughput sensor is provided throughput signal by a belt weigher.

According to yet another aspect of the present invention there is provided control software for a rock crusher control system, said control software being adapted to execute the steps of;

(i) receiving target cascade ratio information, and (ii) receiving a throughput signal indicative of the current crusher throughput, and (iii) determining changes to be made in the settings of the rock crusher's control mechanism or mechanisms to achieve the target cascade ratio, and (iv) transmitting at least one control signal to a control mechanism to implement the changes required in the settings of said control mechanism.

The present invention is adapted to provide a control system for a rock crusher. Preferably this control system may be adapted to control a cascade ratio for a Vertical Shaft Impact crusher, where a cascade ratio is defined as the ratio of amount of material passing through the crusher rotor to the amount of material cascading past the rotor concurrently. The cascade ratio may be calculated by the weight or alternatively the volume of material passing through the VSI Crusher.

The present invention is preferably used with VSI Crusher where the amount of material supplied to the crusher varies over time. This variable throughput for the crusher can normally make the maintenance of a particular cascade ratio a difficult operation, where amount of material entering both the rotor and being placed in a cascade needs to be monitored continuously to ensure the correct cascade ratio is maintained.

Preferably the present invention includes a processing means which may include any type of programmable logic device. Such a processing means may be programmed or loaded with appropriate software instructions or algorithms, which are adapted to control the operation of the processing means and hence the rock crusher to which it is attached or is associated with.

In a further preferred embodiment a processing means may be formed by a Programmable Logic Controller. Programmable Logic Controllers or PLC's are well known in the art and can be obtained relatively inexpensively and also programmed with appropriate software relatively easily.

Reference throughout this specification will also be made to the processing means including or being formed from a Programmable Logic Controller or PLC. However, those skilled in the art should appreciate that other types of programmable logic device may also be used in the implementation of the present invention, and reference to PLC's only throughout this specification should in no way be seen as limiting.

Preferably the PLC employed is adapted to transmit at least one control signal to one or more control systems of the rock crusher. These control systems can be used to vary the amounts of material introduced into the crusher's rotor and also into cascade past the crusher's rotor in a preferred embodiment.

Preferably a control mechanism which is controlled by the present invention may have variable settings which, when modified, adjust the amount of material which the control mechanism either introduces into the crusher or allows to enter the crusher's rotor. These settings may be varied using the present invention to maintain a specific cascade ratio for the crusher where the throughput of the crusher can vary randomly over time.

In a preferred embodiment a control mechanism may be formed from a rotor gate for the crusher. The rotor gate can provide a shut off or valving mechanism which restricts an entry port into the crusher's rotor. By adjusting the settings or positioning of the rotor gate, the size of this entry port into the crusher can be increased or decreased to in turn increase or decrease the rate at which material can enter the rotor.

In a further preferred embodiment an additional control mechanism which may also be controlled by the present invention may be formed from a feed-in mechanism for the crusher. Such a feed-in mechanism may consist of a gate or other similar mechanism which can restrict the total amount of material supplied to the crusher on the whole. The flow rate of material supplied to the crusher can be increased or decreased using such a feed-in mechanism if required through use of the present invention.

Reference throughout this specification will also be made to control mechanisms associated with the present invention being a rotor gate and a feed-in mechanism for the crusher. However, those skilled in the art should appreciate that other types of control mechanism may also be associated with the present invention in other embodiments. For example, in one alternative embodiment a control system in the form of dual supply systems such as a supply hopper, supply belt or belt and hopper combination may be provided to supply material exclusively into cascade or into the rotor. By allowing the control system provided to adjust the amount of volume of material supplied through each supply line or supply train, preferably the cascade ratio of the crusher can then be controlled or modified.

Preferably the processing means may be adapted to receive specific or target cascade ratio information from a user of the control system. This input information may be supplied in any number of ways, through pre-set programmed values incorporated into the operational software of the processing means, or alternatively information or data entered by a user through a keypad linked to the processing means. A user of the present invention may specify the target cascade ratio which they wish a crusher to be run at for a particular type of rock to be crushed through inputting information required into the processing means.

Preferably the processing means is also adapted to receive a throughput signal from at least one throughput sensor. A throughput signal may indicate the current throughput or flow rate of material being supplied to or processed by the crusher. Such a throughput may preferably be measured in mass per unit time, but in other embodiments may be measured in volume per unit time if required.

In a further preferred embodiment the processing means may receive a single throughput signal from a throughput sensor formed by a belt weigher. A belt weigher may weigh the current amount of material on a conveyor belt either supplying the crusher, or alternatively receiving crushed rocks from an outlet of the crusher. A belt weigher can give an indication as to the current throughput of the crusher relatively quickly and easily.

Reference throughout this specification will also be made to the processing means being supplied with a single throughput signal only sourced from a single belt weigher. However, those skilled in the art should appreciate that other configurations of the present invention with different types and numbers of throughput sensors are also envisioned, and reference to the above only throughout this specification should in no way be seen as limiting.

Preferably the processing means may be programmed to use the throughput signal it receives to determine the settings which should be made or maintained for a crusher's control mechanism to achieve a target cascade ratio for a particular throughput value. The crusher may be calibrated prior to use of the control system so that specific settings for the control mechanisms employed will be known for particular combinations of throughput values and target cascade ratios. Through sensing the current throughput of the crusher, the processing means can then determine the correct values for settings to be applied to the control mechanism. At this stage the processing means may then transmit one or more control signals to the appropriate control mechanism to adjust or correct the settings of the mechanism and thereby achieve the target cascade ratio for the crusher.

In a further preferred embodiment the processing means may also be adapted to receive status or setting signals from each of the control mechanisms it is adapted to transmit a control signal or signals to. These status signals can provide information to the control system with regard to the current settings of the associated control mechanism, thereby allowing the control mechanism to adjust or tailor the control signals it sends.

In some instances the control system may also include a display panel or element which is adapted to display information to the user of the crusher. This display panel may indicate the target cascade ratio which the control system is trying to maintain, in addition to other information such as the current settings of the control mechanisms and other information or parameters associated with the operation of the crusher.

In a preferred embodiment the control system may also be adapted to receive a power consumption signal from drive elements or motors associated with the crusher. For example, in a preferred embodiment a motor current value for electric motors used to drive the rotor may be received by the control system This power consumption information may be used to provide a safety facility or function using the present invention. The control system may monitor the power consumed by the drive motors employed, and adjust the settings of the control mechanisms of the crusher to ensure optimum efficiency and safe use of the crusher. For example, if the power consumed is lower than an optimum value the feed-in mechanism for the rotor can be controlled to supply additional rock or improve the flow rate of rock into the crusher. Similar changes can also be made to the settings of the rotor gate to supply additional rock into the interior of the rotor. Conversely, if the power consumed by the drive motors exceeds a maximum safe value the settings of the control mechanism may then be changed to reduce the amount of material being supplied to the crusher or the rotor.

According to another aspect of the present invention there is provided a method of calibrating a control system, characterised by the steps of:

(i) fixing the settings of the crusher's control mechanism at known positions or values, and (ii) observing the cascade ratio for the crush at varying throughput values, and (iii) resetting the settings of the crusher's control mechanism to match the actual cascade ratio observed.

Preferably a crusher may be calibrated for use with the present invention prior to the control system provided being used to control the operation of the crusher. This calibration may be completed in a preferred embodiment through fixing the settings of the crusher's control mechanisms at known positions or values, and observing the cascade ratio for the crusher at varying throughput values. Where the cascade ratio for the crusher is variant to that fixed, resetting the settings of the crusher's control mechanism to match the actual cascade ratio observed. For example, in a preferred embodiment the position of the rotor gate may be fixed and various throughputs can be run through the crusher with the cascade ratios achieved being monitored. In a further preferred embodiment a feed-in mechanism associated with the crusher may also have its setting fixed while various throughputs are run through the crusher and the cascade ratio achieved for the crusher is monitored.

The present invention provides many potential advantages over the prior art. The use of a processing means in the control system allows the present invention to monitor the operation of the crusher and also preferably to maintain a constant cascade ratio for the crusher with varying throughput values.

The present invention may automate the maintenance of a specific cascade ratio through monitoring current throughput for the crusher and in turn automatically controlling the settings of the crusher's rotor gate (and potentially the feed-in mechanism for the crusher) in response to variations in the throughput experienced by the crusher.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
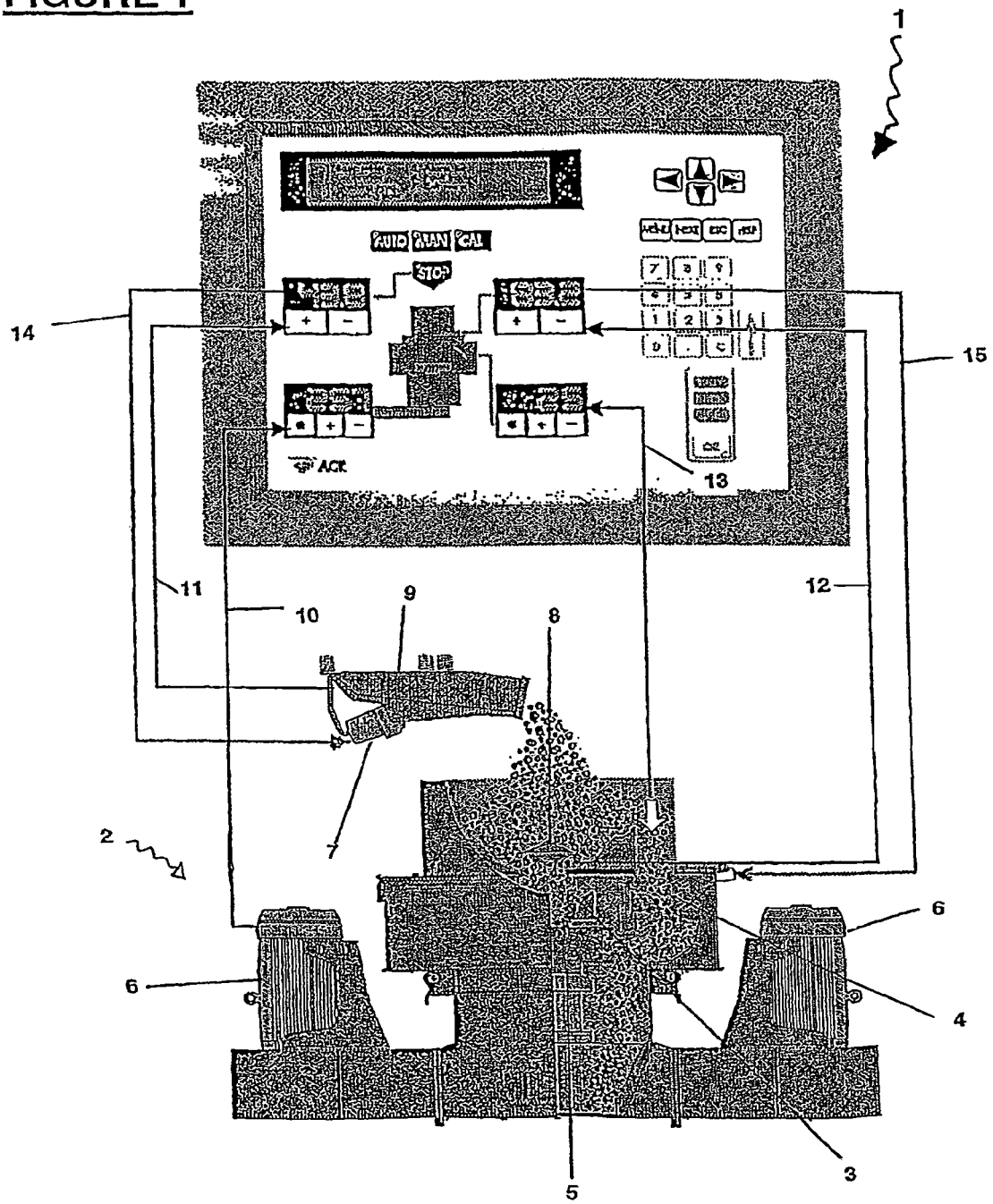
FIG. 1 shows a side cross-section perspective view of the control system and associated rock crusher as configured in accordance with a preferred embodiment.

FIG. 1 shows a front view of the display interface for a control system (1) supplied in accordance with the preferred embodiment to the present invention. Also shown in FIG. 1 is a side cross-section view of a VSI Rock Crusher which the control system (1) is adapted to control.

The crusher (2) is top fed and adapted to divide the stream of rock it is supplied with into a rotor stream (3) and a cascade stream (4). Rock supplied into the rotor stream (3) is spun by the crusher's rotor (5) and ejected out into the cascade stream rock (4) to crush same. The rotor (5) is driven by a pair of electric drive motors (6).

The flow rates of material supplied to both the rotor and into cascade can be adjusted through use of a pair of control mechanisms formed from a feed-in mechanism control (7) and a rotor gate (8).

The feed-in control mechanism can tilt a supply spout (9) for rock entering the crusher up and down to in tarn restrict the amount of material entering the crusher and therefore the current throughput of the crusher.

The rotor gate (8) can be moved up and down from the position shown with respect to FIG. 1 to increase or decrease the size of the access port into the rotor of the crusher. This will in turn adjust the amount of material in the rotor and therefore the ratio of material in the rotor as opposed to material placed in the cascade (being the cascade ratio).

The control system (1) is also adapted to receive a number of information signals from the crusher (2). For example, the control system is adapted to receive a motor current signal (10), indicating the amount of current consumed by the motor (6). The control system may also receive a number of mechanism status signals such as, for example, a position or status (11) relating to the configuration of the feed in mechanism (7). A rotor gate status signal (12) is also supplied to the control system to indicate the current position or settings for the rotor gate (8).

The control system (1) is also adapted to receive target cascade ratio information from a user using the keypad shown. This specified target ratio can be indicated on the display interface of the control system.

The control system (1) is also adapted to transmit a pair of control signals (14, 15) to the control mechanisms associated with the feed-in mechanism and rotor gate. These control signals can be used to adjust the settings of each of these control mechanisms, and thereby vary the amount of material being supplied to both the crusher on the whole and also the amount of material entering the rotor when compared with material being placed into cascade. These control signals can therefore be used to maintain a selected or target cascade ratio for the rotor.

The control system (1) is also adapted to receive a throughput signal from a throughput sensor (not shown). In the preferred embodiment this throughput sensor may be provided through a belt weigher used to weigh either the material exiting the crusher or material about to be supplied to the crusher.

This throughput signal is used by the control system to determine whether changes will need to be made to the settings of the control mechanisms (7, 8) to achieve the target cascade ratio displayed at (13). Through prior calibration of the crusher, specific settings for the control mechanisms are pre-calculated for specific combinations of cascade ratio and throughput for the crusher. By measuring the current throughput and receiving information relating to the target cascade ratio, the correct settings for the control mechanisms are then be pre-calculated and consequently implemented by the control system.

Figure 2:
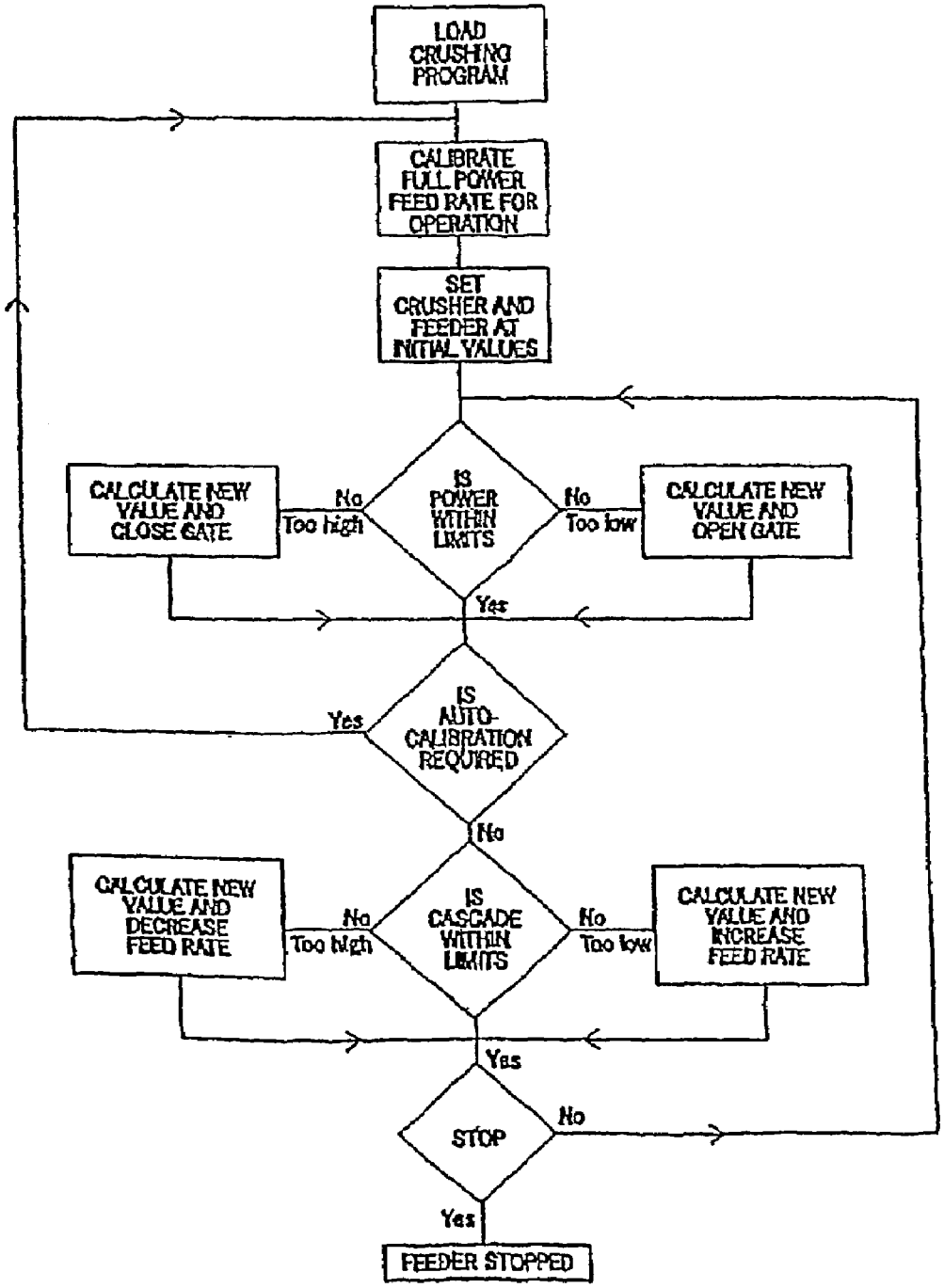
FIG. 2 shows a flowchart for an algorithm implementing control software used in the control system discussed with respect to FIG. 1.

FIG. 2 shows a flow chart for control software programmed into the control system shown and discussed with respect to FIG. 1. The control software employed in this instance is also adapted to provide a fail safe system for the rock crusher so that the drive motors (6) will not be run at a higher rate or capacity than is safe.

As shown with respect to FIG. 2 the initial instructing program of the control system is loaded when a programmable logic controller used to implement the control system is powered up. Calibration information is then loaded in conjunction with the software and initial control signals are sent to the control mechanisms of the crusher to place same in initial starting positions.

Following this initial start up period the software runs a series of loops until operation of the crusher is terminated. In the first loop the control system checks to ensure that the electric current supplied or drawn by the drive motor (6) is within acceptable limits. If the current drawn is too high the rotor gate will be closed to reduce the amount of material entering the rotor and therefore reduce the load on the rotor. Conversely if the current drawn is too low the crusher is not working to optimum capacity and the rotor gate will be opened to allow further material to be supplied into the crusher.

As a follow on stage the software employed also allows the user of the crusher to run an automatic calibration process which in effect re-starts the software to its beginning stages.

The secondary loop of instructions run by the software monitors the cascade ratio for the crusher based on an input signal from a belt weigher and from status signals sent to the control system by the control mechanisms employed. During this loop the control software can examine whether the current cascade ratio is too high or too low and make appropriate changes to the settings of the feed-in control mechanism to achieve a target cascade ratio.

These loops and instructions are run continuously until a stop instruction is received from a user and the operation of the crusher is stopped.

Aspects of the present invention have been described by way of example only and it should be appreciated that modifications and additions may be made thereto without departing from the scope thereof as defined in the appended claims.

What is claimed is:

1. A control system for a rock crusher having a first feed of material through a rotor and at least one second feed of material in a cascade past the rotator, said control system being configured to control a cascade ratio of said crusher, wherein a portion of material entering the crusher is placed into cascade, and the remainder of said material entering the crusher is supplied to a crusher rotor, the control system including a processing arrangement, said processing arrangement being configured to receive a throughput signal from at least one throughput sensor, said processing arrangement also being configured to transmit at least one control signal to at least one control mechanism of the crusher, wherein at least one control signal or signals are transmitted to each control mechanism to adjust the amount of material entering the crusher rotor to provide a specific cascade ratio for said crusher in response to a randomly variable throughput for said crusher.

2. A control system as claimed in claim 1 wherein the rock crusher is a vertical shaft impact crusher.

3. A control system as claimed in claim 1 wherein at least one control signal is transmitted to at least one control mechanic for a rotor gate for the crusher.

4. A control system as claimed in claim 1 wherein the control signal is transmitted to a control mechanism for a crusher feed-in mechanism.

5. A control system as claimed in claim 3 wherein the control mechanism has variable settings.

6. A control system as claimed in claim 1 wherein the cascade ratio is defined as the ratio of amount of material passing through the crusher rotor to the amount of material cascading past the rotor concurrently.

7. A control system as claimed in claim 6 where the cascade ratio is calculated with reference to weight of material passing through the crusher.

8. A control system as claimed in claim 6 where the cascade ratio is calculated with reference to the volume of material passing through the crusher.

9. A control system as claimed in claim 1 where the amount of material supplied to the crusher varies over time.

10. A control system as claimed in claim 9 wherein the processing arrangement includes a programmable logic device.

11. A control system as claimed in claim 10 configured to receive a power consumption signal from drive elements or motors associated with the crusher.

12. A control system as claimed in claim 11 wherein the power consumption signal is a motor current value for motors used to drive the rotor.

13. A control system as claimed in claim 9 wherein the programmable logic device is a programmable logic controller.

14. A control system as claimed in claim 9 wherein the programmable logic device is configured to receive specific or target cascade ratio information from a user of the control system.

15. A control system as claimed in claim 14 wherein the throughput sensor is provided throughput signal through at least one belt weigher.

16. A control system as claimed in claim 9 wherein the programmable logic device is configured to receive a throughput signal from at least one throughput sensor.

17. A control system as claimed in claim 9 wherein the programmable logic controller is configured to transmit at least one control signal to one or more control systems of the rock crusher.

18. A control system as claimed in claim 1 which includes an element which is configured to display information to the user of the crusher.

19. A control system as claimed in claim 18 wherein the element configured to display information is a display panel.

20. A method of calibrating a control system as claimed in claim 1, wherein the steps of:

(i) fixing the settings of the crusher's control mechanism at known positions or values, and (ii) observing the cascade ratio for the crush at varying throughput values, and (iii) resetting the settings of the crusher's control mechanism to match the actual cascade ratio observed.

21. A control software for a rock crusher control system, wherein a portion of material entering the crusher is placed into a cascade via a cascade feed and the remainder of said material entering the crusher is supplied to the crusher rotor via a crusher rotor feed, said control software being stored as a machine readable program code on a computer readable medium so as to be executable by a computer, and configured to execute the steps of;

(i) receiving target cascade ratio information, and (ii) receiving a throughput signal indicative of the current crusher throughput, and (iii) determining changes to be made in the settings of the rock crusher's control mechanism or mechanisms to achieve the target cascade ratio, and (iv) transmitting at least one control signal to a control mechanism to implement the changes required in the settings of said control mechanism or mechanisms.

* * * * *